US006708509B1

(12) United States Patent
Senner

(10) Patent No.: US 6,708,509 B1
(45) Date of Patent: Mar. 23, 2004

(54) ICE MAKER ASSEMBLY FOR A REFRIGERATOR

(75) Inventor: Kurt C. Senner, Galesburg, IL (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/385,694

(22) Filed: Mar. 12, 2003

(51) Int. Cl.[7] ..... F25C 5/18
(52) U.S. Cl. ..... 62/137; 62/344
(58) Field of Search ..... 62/137, 344, 353, 62/382, 298

(56) References Cited

U.S. PATENT DOCUMENTS 3,643,464 A * 2/1972 Hilliker et al. ..... 62/344
3,883,204 A * 5/1975 Prada et al. ..... 312/273
4,285,212 A 8/1981 Prada ..... 62/344
4,665,708 A 5/1987 Tate, Jr. et al. ..... 62/66
4,680,943 A 7/1987 Mawby et al. ..... 62/300
5,806,333 A * 9/1998 Kim et al. ..... 62/353
6,109,476 A 8/2000 Thompson et al. ..... 222/1
6,148,624 A 11/2000 Bishop et al. ..... 62/137

* cited by examiner

*Primary Examiner*—William E. Tapolcai
(74) *Attorney, Agent, or Firm*—Diederiks & Whitelaw, PLC

(57) ABSTRACT

An ice maker assembly, including at least one support arm, a shelf arranged atop the support arm, a bin slidably mounted to the support arm beneath the shelf, and an ice maker unit adapted to develop ice to be stored in the bin, is adapted to be selectively, vertically adjustable within a freezer compartment of a refrigerator. The entire ice maker assembly is preferably suspended from a pair of spaced, vertically extending support rails arranged on the back wall of the freezer compartment. The shelf preferably includes a transparent platform which visually exposes the bin.

18 Claims, 2 Drawing Sheets

ICE MAKER ASSEMBLY FOR A REFRIGERATOR

BACKGROUND OF THE INVENTION

1. Field of the Invention

The present invention pertains to the art of refrigerators and, more particularly, to an ice maker assembly for a refrigerator.

2. Discussion of the Prior Art

It is now common practice in the art of refrigerators to provide an automatic ice maker within a freezer compartment of a refrigerator, wherein the ice maker is linked to a water supply line used to fill an ice cube tray which is emptied into a bin following a freezing period. The stored ice can be retrieved directly from the bin located in the freezer compartment or the refrigerator can incorporate a dispensing arrangement wherein the ice is directed into a recessed receiving area formed in a front panel of the refrigerator by the selective activation of a drive unit, such as a rotatable auger, located in the bin. Most often, such ice dispensing arrangements incorporate a mechanism whereby the ice can be selectively crushed prior to reaching the receiving area.

Typically, the overall ice maker unit is fixed within the freezer compartment with the bin arranged beneath the unit. The level of ice maintained in the bin is generally established by a variable position bale arm which projects into the bin. As the level of ice in the bin rises, the bale arm is shifted. When a prerequisite amount of ice is present, the bale arm functions to terminate the production of additional ice. In any event, the fixed mounting of the ice maker unit represents a design constraint on the overall design of the freezer compartment.

In at least one known arrangement as represented by U.S. Pat. No. 6,148,624, the amount of ice produced and stored in a bin is controlled, not by shifting a bale arm relative to an ice maker unit, but by actually shifting the entire ice maker unit relative to the bin. Although this arrangement does enable adjusting the positioning of an ice maker, since the bin is essentially fixed, the arrangement is actually more detrimental to the storage capacity and design of the freezer compartment as more space must be dedicated to accommodate desired adjustments. That is, a substantial amount of space is maintained available above the ice maker is enable shifting of the unit when desired. Regardless of whether the unit is ever adjusted, a substantial amount of potential storage space is dedicated to the system.

Based on the above, there exists a need in the art for an ice maker assembly which can be readily, vertically repositioned is a simple manner, preferably as desired by the consumer, in order to easily reconfigure the overall storage design of a refrigerator freezer compartment. In addition, there exists a need for a versatile and efficiently configured ice maker assembly which, while being vertically adjustable, still enhances the overall food storage arrangement in the freezer compartment. Particularly, there exists a need for enabling an entire ice maker assembly, including the ice maker unit and bin, to be vertically adjustable such that the amount of space which needs to be dedicated to the system is unchanged.

SUMMARY OF THE INVENTION

The present invention is directed to an ice maker assembly that is adapted to be selectively, vertically adjustable within a freezer compartment of a refrigerator. The ice maker assembly includes an ice maker unit supported beneath a shelf of the assembly. Both the shelf and the ice maker unit are preferably suspended from a pair of spaced, vertically extending support rails arranged within the freezer compartment. The assembly also includes a slidably supported bin located below the ice maker unit into which ice, developed by the ice maker unit, is ejected.

In accordance with the most preferred form of the invention, the assembly includes a pair of spaced support arms that can be cantilevered from the support rails provided on a back wall of the refrigerator freezer. Extending across the top of the arms is the shelf which is preferably transparent. The arms also slidably support the bin that is adapted to store the ice. The ice maker is actually supported by a back plate attached to the support arms, while being electrically connected to a power supply port provided at the back wall of the freezer compartment. A water fill tube is also directed to the ice maker.

With this construction, the overall ice maker assembly generally appears as a combination shelf and bin arrangement in the freezer compartment. The ice maker assembly can be readily, vertically adjusted as an integral unit, with the range of adjustability being merely limited by the electrical and water connections. Preferably, the ice maker assembly can be repositioned between an upper portion of the freezer compartment to a substantially mid-level position.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
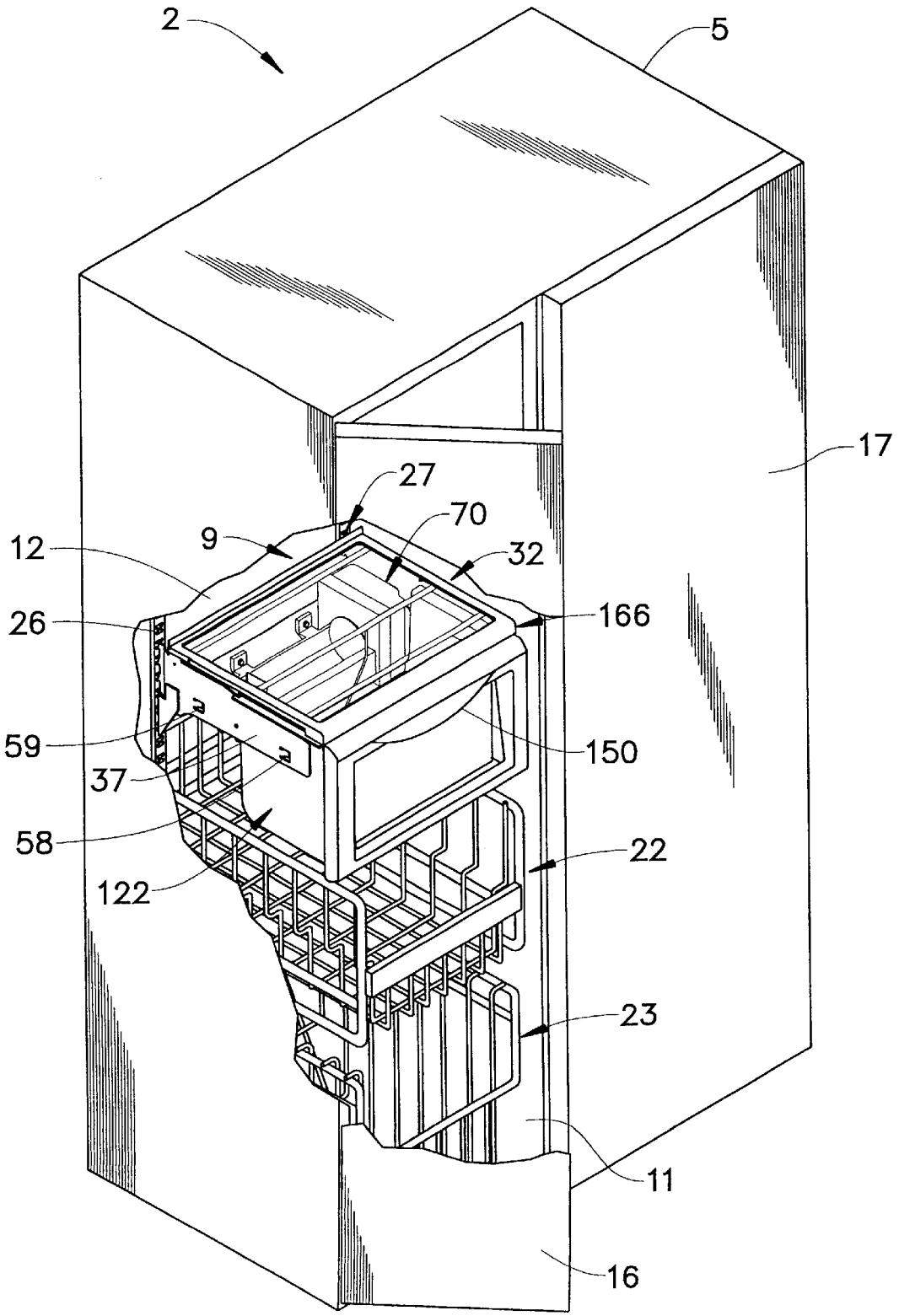
FIG. 1 is a upper left, partial sectional view, of a side-by-side refrigerator incorporating the ice maker assembly of the invention.

With initial reference to FIG. 1, the present invention will be described with respect to a side-by-side refrigerator which is generally indicated at 2. As shown, refrigerator 2 includes a cabinet shell 5 within which is provided a freezer compartment 9 defined, at least in part, by a side wall 11 and a back wall 10. Freezer compartment 9 can be selectively accessed by means of a pivotally mounted freezer door 16. Adjacent freezer door 16 is a fresh food door 17, behind which is arranged a fresh food compartment (not shown). Obviously, this basic structure for refrigerator 2 is widely known in the art and therefore has only been provided for the sake of completeness. In a manner also known in the art, freezer compartment 9 is preferably provided with a plurality of storage baskets 22 and 23, as well as a pair of vertically extending support rails 26 and 27 provided at laterally spaced positions along back wall 12.

Figure 2:
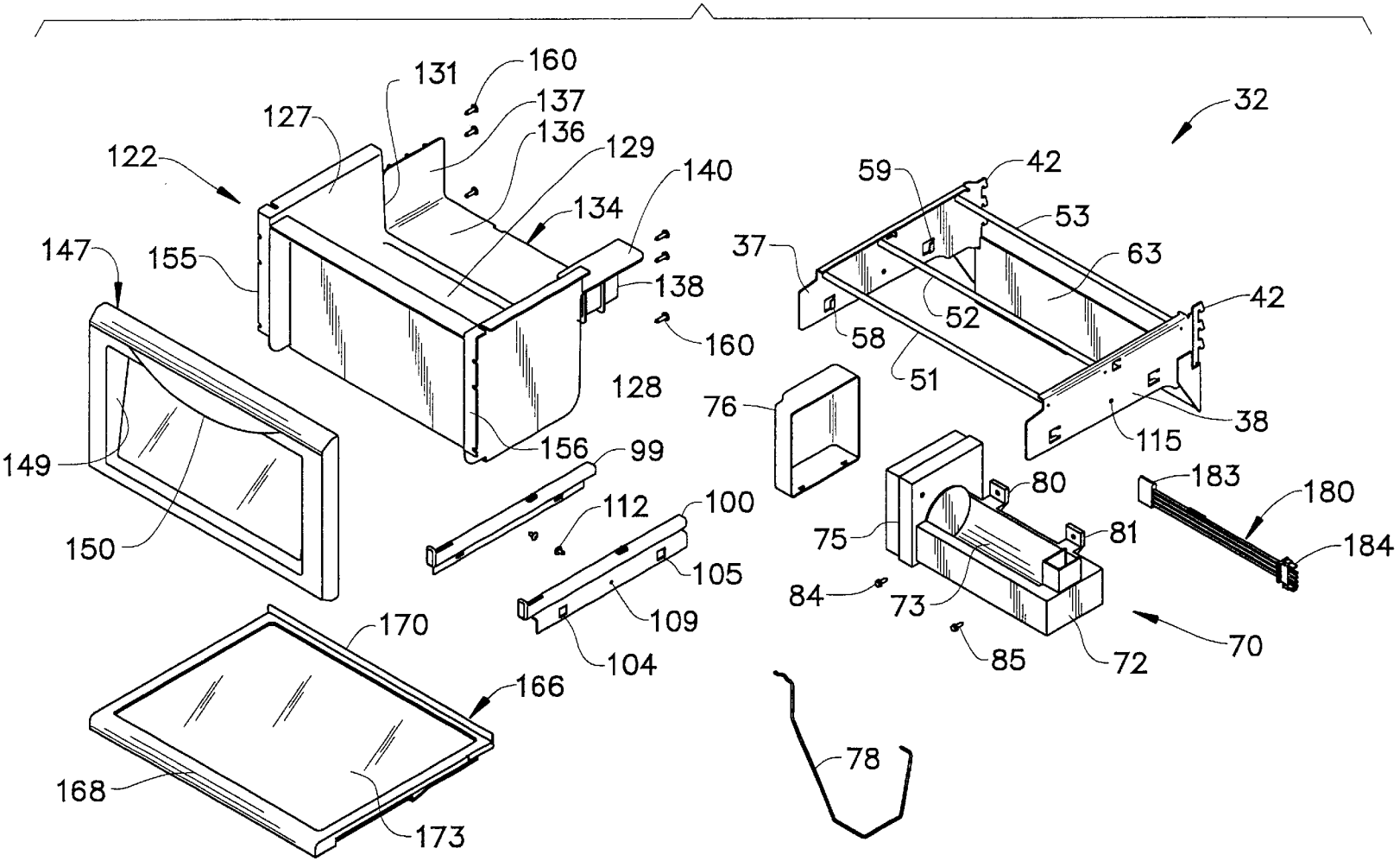
FIG. 2 is an exploded view of the ice maker assembly of FIG. 1.

The present invention is particularly directed to the incorporation of ice maker assembly 32 within refrigerator 2. As shown in each of FIGS. 1 and 2, ice maker assembly 32 includes a pair of laterally spaced support arms 37 and 38, each of which is preferably provided with a plurality of rear hook elements 42. Interconnecting support arms 37 and 38 are a plurality of fore-to-aft spaced cross braces 51–53. Each support arm 37, 38 is preferably made of metal and, as best shown in FIG. 2, includes a pair of spaced tabs 58 and 59 which are lanced out of a respective support arm 37, 38. Provided across the rear of support arms 37 and 38 is a back plate 63 which, in the most preferred embodiment shown, wraps around and is fixedly secured to support arms 37 and 38. As will be discussed more fully below, support arms 37 and 38 are adapted to be hung, in a cantilevered manner, from support rails 26 and 27 with the use of hook elements 42.

Ice maker assembly 32 also includes an ice maker unit 70 including a main body portion 72, a trough portion 73, a motor end mount 75, an end cover 76, and a bale arm 78. In general, the general construction and operation of ice maker unit 70 is known in the art and does not form part of the present invention. However, in accordance with the invention, ice maker unit 70 is secured to back plate 63 so as to be suspended at a select vertical location upon support rails 26 and 27 through support arms 37 and 38. Although ice maker unit 70 could be attached to support arms 37 and 38 in a variety of ways, in accordance with the most preferred form of the invention, ice maker unit 70 is provided with a pair of brackets 80 and 81 which are fixed to back plate 63 by means of screws 84 and 85.

Also preferably provided as part of ice maker assembly 32 is a pair of side rails 99 and 100. As shown, each side rail 99, 100 is formed with a pair of spaced openings 104 and 105, as well as a central aperture 109. With this construction, each side rail 99, 100 can be positioned against a respective support arm 37, 38 with openings 104 and 105 receiving a pair of tabs 58 and 59. A screw 112 is provided which extends through aperture 109 and is threadably received in an opening 115 provided in a respective support arm 37, 38.

Ice maker assembly 32 also includes a bin 122. Most preferably, bin 122 is integrally molded of plastic to include a front wall 126, side walls 127 and 128, a bottom wall 129, and an open rear wall portion 131. In addition, bin 122 preferably includes a ledge member 134 having a base 136, upstanding sides 137 and 138, and an upper plateau portion 140. Furthermore, bin 122 is provided with a separate front panel 147 having a recessed zone 149 and a handle portion 150. As shown, side walls 127 and 128 lead to front, out-turned flanges 155 and 156. In the embodiment shown, front panel 147 is fixed across front wall 126 by means of a plurality of screws 160 which extend through flanges 155 and 156 and into front panel 147 from behind.

In accordance with the most preferred form of the invention, ice maker assembly 32 further includes a shelf 166 including a peripheral rim 168, an upstanding rear strip 170 and a platform 173 which is preferably made from visually transparent material such as glass, but which could be opaque. In general, platform 173 is encapsulated by rim 168 to define a spill-proof shelf. It should be recognized that encapsulated shelving of this type is known for use in at least fresh food compartments of refrigerators. In accordance with the present invention, shelf 166 is mounted upon support arms 37 and 38, above ice maker unit 70. In the embodiment shown, shelf 166 is fixed upon support arms 37 and 38. However, it should be understood that shelf 166 could be readily mounted for sliding movement into and out of freezer compartment 9 relative to support arms 37 and 38. Finally, a wire harness 180 is provided. Wire harness 180 includes opposing terminal connectors 183 and 184 for providing required electrical connections to ice maker unit 70, preferably through back wall 12. Although not shown, a water supply tube would also be routed to ice maker unit 70.

With this overall construction for ice maker assembly 32, ice maker unit 70 is fixed relative to support arms 37 and 38, shelf 166 is supported atop support arms 37 and 38, and bin 122 is slidably supported for movement relative to support arms 37 and 38 through side rails 99 and 100. When bin 122 is in a rearmost position, ledge member 134 projects below and about the ends of ice maker unit 70. As ice maker unit 70 produces ice, that ice will be dispensed into bin 122. Bale arm 78 projects into bin 122 so that ice maker unit 70 will automatically stop producing ice when the ice stored in bin 122 reaches a predetermined level. A user can visually observe the level of ice stored in bin 122 through platform 173, at least when platform 173 is made visually transparent so as to expose the interior of bin 122. The user can readily retrieve the ice by slidably withdrawing bin 122 upon side rails 99 and 100 from freezer compartment 9. In addition, the entire ice maker assembly 32 can advantageously be selectively, vertically re-positioned upon support rails 26 and 27 within freezer compartment 9, with the degree of adjustability essentially being only limited by the slack provided for wire harness 180 and the water flow tube for ice maker unit 80. In any event, it should be readily apparent that ice maker assembly 32 defines an extremely versatile and aesthetically pleasing overall arrangement which enhances the overall food storage system in freezer compartment 9.

Although described with reference to a preferred embodiment of the invention, it should be readily understood that various changes and/or modifications can be made to the invention without departing from the spirit thereof. For instance, other support arrangements for bin 122, shelf 166 and the overall ice maker 32 assembly could be readily employed while still providing the overall adjustability and relative movements desired. In general, the invention is only intended to be limited by the scope of the following claims.

I claim:

1. A refrigerator comprising:

a cabinet shell;

a freezer compartment located in the cabinet shell, said freezer compartment being defined, at least in part, by a back wall; and an ice maker assembly vertically, adjustably mounted in the freezer compartment, said ice maker assembly including:

at least one support arm mounted in the freezer compartment;

a bin slidably attached to the at least one support arm for selective movement into and out of the freezer compartment; and an ice maker unit supported by the at least one support arm within the freezer compartment, said ice maker unit being adapted to produce ice cubes which are stored in the bin.

2. The refrigerator according to claim 1, further comprising: a pair of support rails mounted in spaced relationship on the back wall of the freezer compartment, said at least one support arm including a pair of laterally spaced support arms cantilevered from the support rails.

3. The refrigerator according to claim 2, further comprising:

a plurality of cross braces interconnecting the support arms; and a back plate attached to and projecting below the support arms.

4. The refrigerator according to claim 2, wherein the ice maker unit is directly attached to the back plate.

5. The refrigerator according to claim 1, wherein the bin includes a front wall, a pair of side walls and a bottom wall, said bin further including an open rear wall portion.

6. The refrigerator according to claim 5, wherein said ice maker unit includes a ice level sensing bale arm which extends into the bin.

7. The refrigerator according to claim 1, wherein said bin includes a rearwardly projecting ledge member located adjacent the open rear wall portion, said ice maker unit being adapted to be positioned above the ledge member.

8. The refrigerator according to claim 1, wherein said ice maker assembly further includes a shelf positioned upon the at least one support arm, above the bin.

9. The refrigerator according to claim 8, wherein the shelf includes a transparent platform which visually exposes an interior of the bin.

10. A refrigerator comprising:

a cabinet shell;

a freezer compartment located in the cabinet shell, said freezer compartment being defined, at least in part, by a back wall; and an ice maker assembly vertically, adjustably mounted in the freezer compartment, said ice maker assembly including:

at least one support arm mounted in the freezer compartment;

a shelf supported by the at least one support arm; and an ice maker unit supported by the at least one support arm below the shelf within the freezer compartment.

11. The refrigerator according to claim 10, wherein the ice maker assembly further includes a bin slidably attached to the at least one support arm for selective movement into and out of the freezer compartment, said ice maker unit being adapted to produce ice cubes which are stored in the bin.

12. The refrigerator according to claim 11, wherein the shelf includes a transparent platform which visually exposes an interior of the bin.

13. The refrigerator according to claim 11, wherein the bin includes a front wall, a pair of side walls and a bottom wall, said bin further including an open rear wall portion.

14. The refrigerator according to claim 13, wherein said ice maker unit includes a ice level sensing bale arm which extends into the bin.

15. The refrigerator according to claim 11, wherein said bin includes a rearwardly projecting ledge member located adjacent the open rear wall portion, said ice maker unit being adapted to be positioned above the ledge member.

16. The refrigerator according to claim 10, further comprising: a pair of support rails mounted in spaced relationship on the back wall of the freezer compartment, said at least one support arm including a pair of laterally spaced support arms cantilevered from the support rails.

17. The refrigerator according to claim 16, further comprising:

a plurality of cross braces interconnecting the support arms; and a back plate attached to and projecting below the support arms.

18. The refrigerator according to claim 17, wherein the ice maker unit is directly attached to the back plate.

* * * * *